US008315780B2

(12) United States Patent
Toyohara et al.

(10) Patent No.: US 8,315,780 B2
(45) Date of Patent: Nov. 20, 2012

(54) HIGH PRESSURE FUEL PUMP CONTROL APPARATUS FOR INTERNAL COMBUSTION ENGINE

(75) Inventors: Masahiro Toyohara, Hitachiota (JP); Kazunori Kondo, Hitachinaka (JP); Satoru Okubo, Hitachinaka (JP); Takashi Okamoto, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 727 days.

(21) Appl. No.: 12/512,615

(22) Filed: Jul. 30, 2009

(65) Prior Publication Data

US 2010/0082223 A1 Apr. 1, 2010

(30) Foreign Application Priority Data

Sep. 30, 2008 (JP) ..... 2008-252120

(51) Int. Cl.
*F02M 37/06* (2006.01)

(52) U.S. Cl. ..... 701/105; 123/456; 123/496; 123/507; 123/508

(58) Field of Classification Search ..... 701/103, 701/105; 123/446, 456, 496, 503, 506, 507, 123/508

See application file for complete search history.

(56) References Cited

U.S. PATENT DOCUMENTS

| | | | | |
|---|---|---|---|---|
| 5,678,521 | A * | 10/1997 | Thompson et al. | 123/447 |
| 6,135,090 | A * | 10/2000 | Kawachi et al. | 123/446 |
| 6,318,343 | B1 | 11/2001 | Nakagawa et al. | |
| 7,546,832 | B2 * | 6/2009 | Okamoto et al. | 123/506 |
| 7,690,353 | B2 * | 4/2010 | Shafer et al. | 123/445 |
| 7,757,663 | B2 * | 7/2010 | Usui et al. | 123/467 |
| 8,033,268 | B2 * | 10/2011 | Gwidt et al. | 123/446 |
| 2001/0006061 | A1 | 7/2001 | Shimada et al. | |
| 2005/0126539 | A1 * | 6/2005 | Okamoto | 123/446 |

FOREIGN PATENT DOCUMENTS

| | | |
|---|---|---|
| EP | 1 281 860 A2 | 2/2003 |
| EP | 1 281 860 A3 | 2/2003 |
| JP | 2005-76554 A | 3/2005 |
| JP | 2006-37836 A | 2/2006 |

OTHER PUBLICATIONS

Japanese Office Action including partial translation dated Feb. 1, 2011 (Six (6) pages).

European Search Report dated Feb. 3, 2010 (Four (4) pages).

* cited by examiner

*Primary Examiner* — Erick Solis
(74) *Attorney, Agent, or Firm* — Crowell & Moring LLP

(57) ABSTRACT

There is provided a high pressure fuel pump control system for an internal combustion engine which enables fuel pressure control with high precision without being restricted by the number of cylinders of the internal combustion engine or the number of phase sensor signals and the number of cam noses which vertically drives a plunger of a high pressure fuel pump even when a camshaft phase varies by a variable valve timing mechanism by using the high pressure fuel pump with a solenoid valve. The control system has a means which changes an effective stroke by driving the solenoid valve in the high pressure fuel pump, and has a means which changes the drive timing of the high pressure fuel pump based on a cylinder recognition value of the internal combustion engine with the cam angle detecting means as an origin.

3 Claims, 15 Drawing Sheets

HIGH PRESSURE FUEL PUMP CONTROL APPARATUS FOR INTERNAL COMBUSTION ENGINE

BACKGROUND OF THE INVENTION

1. Field of the Invention

The present invention relates to an apparatus for an internal combustion engine mounted on an automobile or the like, and particularly to a high pressure fuel supply apparatus including a high pressure fuel pump.

2. Description of the Related Art

Present automobiles are required to reduce emission gas substances such as carbon monoxide (CO), hydrocarbon (HC) and nitrogen oxide (NOx), which are included in emission gas of the automobiles, from the viewpoint of environmental conservation, and for the purpose of reduction of the emission gas substances, development of a direct injection engine has been carried out. In the above described direct injection engine, a fuel within a common rail of which pressure is regulated into a high fuel pressure by a high pressure fuel pump is directly injected into a combustion chamber of a cylinder by an injector, to attempt reduction or the like of the emission gas substances due to engine output improvement and combustion improvement.

The regulation of the fuel pressure in the above described common rail is performed by regulating a fuel discharge quantity from the above described high pressure pump connected to a camshaft for intake or exhaust of the internal combustion engine. In the conventional art, the fuel discharge quantity from the high pressure fuel pump is operated in synchronization with the above described camshaft, and therefore regulated by performing desired fuel discharge quantity control by changing the timing of ON and OFF of the solenoid valve in a high pressure pump in accordance with the phase of the camshaft.

As such an art, there is known the one described in JP-A-2005-76554, for example. It is known, as a control method of the fuel discharge quantity of the high pressure fuel pump having a variable valve timing system, that the apparatus of this publication controls the ON/OFF timing of the solenoid valve from a camshaft sensor by using a camshaft sensor signal which synchronizes with the rotation of the camshaft with the camshaft sensor signal as an origin, for the purpose of simplification and enhancement of control precision of the ON/OFF control timing of the solenoid valve in the high pressure fuel pump for controlling the discharge position of the high pressure fuel pump with respect to the control position of the variable valve timing. This publication shows a method of coping with both calculation load of a CPU in the control system and control precision of the high pressure pump compatible, which method does not require performing complicated correction of the ON/OFF timing of the above described solenoid valve with respect to the control position of the variable valve timing by using the camshaft sensor signal as an origin, and further, properly uses a method of ensuring angle control precision by the crankshaft sensor signal in addition to the camshaft sensor signal information in accordance with the operating state of the internal combustion engine, and a method of controlling the ON/OFF timing of the above described solenoid value only by the above described camshaft sensor signal information without using the crankshaft sensor.

BRIEF SUMMARY OF THE INVENTION

However, when the apparatus of the above described JP-A-2005-76554 is applied to an internal combustion engine having a variable valve timing control system, there is the problem of giving limitation to the signal mode of the camshaft sensor and the cam nose number for the pump of the camshaft which vertically moves in the cylinder in the high pressure pump.

More specifically, in the apparatus of the above described publication, the fuel discharge quantity control from the high pressure fuel pump is performed stably by controlling the ON/OFF timing of the solenoid valve with the camshaft sensor signal as an origin even when the phase of the camshaft linked with the high pressure fuel pump changes by the variable valve timing control system, however, this is limited to the case where the relative relationship of the camshaft sensor signal and the cam nose for driving the high pressure pump is consistent with each other. For example, in the case of a four-cylinder internal combustion engine, there are four kinds of modes of the camshaft sensor signals (for example, the modes of the number of camshaft sensor signals are 1→3→4→2) in general. When the number of drive cam noses of the camshaft which drives the high pressure fuel pump applied to this internal combustion engine is three, the timing for controlling ON/OFF of the solenoid valve from the camshaft sensor signal differs, and thus there is the problem that desired fuel quantity discharge control cannot be realized and the fuel pressure in the common rail becomes unstable.

This problem will be described using FIG. 10.

FIG. 10 shows one example of the case in which three drive cam noses of the camshaft for driving the high pressure fuel pump are applied to the four-cylinder internal combustion engine. A phase sensor signal in the uppermost stage shows one example of the mode of the above described camshaft sensor signal (hereinafter, called a phase sensor signal). A position sensor signal shows one example of the mode of the above described crankshaft sensor signal (hereinafter, called a position sensor signal). Plunger displacement in FIG. 10 shows the displacement of a plunger in the high pressure fuel pump which is operated by the high pressure fuel pump drive cam of the camshaft.

STANG 1 to 3 in FIG. 10 show the timings of turning ON the solenoid valve of the high pressure fuel pump, OFFANG 1 to 3 show the timings of turning OFF the above described solenoid valve. When the fuel discharge quantity from the high pressure fuel pump is controlled, it is necessary to perform control corresponding to the position of the cam noses for driving the high pressure fuel pump. In this case, the ON timing and the OFF timing of the above described solenoid valve from the phase sensor signal need to be changed for every phase sensor signal.

If the ON/OFF timing of the solenoid valve is not changed irrespective of the phase sensor signal, the fuel discharge quantity from the high pressure fuel pump becomes unstable, and the fuel pressure control in the common rail cannot be performed.

In order to attain the above-described object, in a high pressure fuel pump control system according to the present invention, it includes a camshaft which is driven in synchronization with a crankshaft of an internal combustion engine, a cam angle detecting means which generates a cam angle signal in synchronization with rotation of the camshaft, a crank angle detecting means which generates a crank angle signal in synchronization with rotation of the crankshaft, a means which performs cylinder recognition of the internal combustion engine by the cam angle detecting means and the crank angle detecting means, a high pressure fuel pump having a suction stroke and a spill stroke of the high pressure fuel pump in synchronization with the rotation of the camshaft, and a means which relates to the spill stroke of the high pressure fuel pump and changes an effective stroke by driving a solenoid valve in the high pressure fuel pump, wherein the drive timing of the high pressure fuel pump is changed based on a cylinder recognition value of the internal combustion engine with the cam angle detecting means as an origin.

Further, control of the drive timing of the above described high pressure fuel pump is executed based on the number of the crank angle signals and a period of the crank angle signal by the crank angle detecting means.

Alternatively, at least when abnormality of the crank angle detecting means is recognized, control of the drive timing of the above described high pressure fuel pump is executed based on a period of the cam angle signal.

The high pressure fuel pump control system for an internal combustion engine of the present invention configured as described above can calculate a suitable power distribution start or end demand phase in a drive timing calculating part in the control system to carry out the power distribution start and end in accordance with the demand phase in a drive signal output part in the control system, even when a camshaft phase varies by the variable valve timing control system for an internal combustion engine, and therefore can contribute to stabilization of a fuel system, stabilization of combustion, and improvement in emission gas performance.

Further, since desired discharge control of the high pressure fuel pump becomes enabled also when abnormality occurs in the crankshaft signal, the control system can contribute to stability of combustion and improvement in emission gas performance.

As will be understood from the above description, the high pressure fuel pump control system according to the present invention calculates a suitable power distribution start/end demand phase in a phase calculating part in the control system to make it possible to carry out start and end of power distribution in accordance with the above described demand phase in the drive signal output part in the above described control system. Therefore, the high pressure fuel pump control system can contribute to stabilization of a fuel system, stabilization of combustion, and improvement in emission gas performance.

Further, even when abnormality occurs in a position sensor signal, equivalent performance can be achieved.

Other objects, features and advantages of the invention will become apparent from the following description of the embodiments of the invention taken in conjunction with the accompanying drawings.

DETAILED DESCRIPTION OF THE INVENTION

Figure 1:
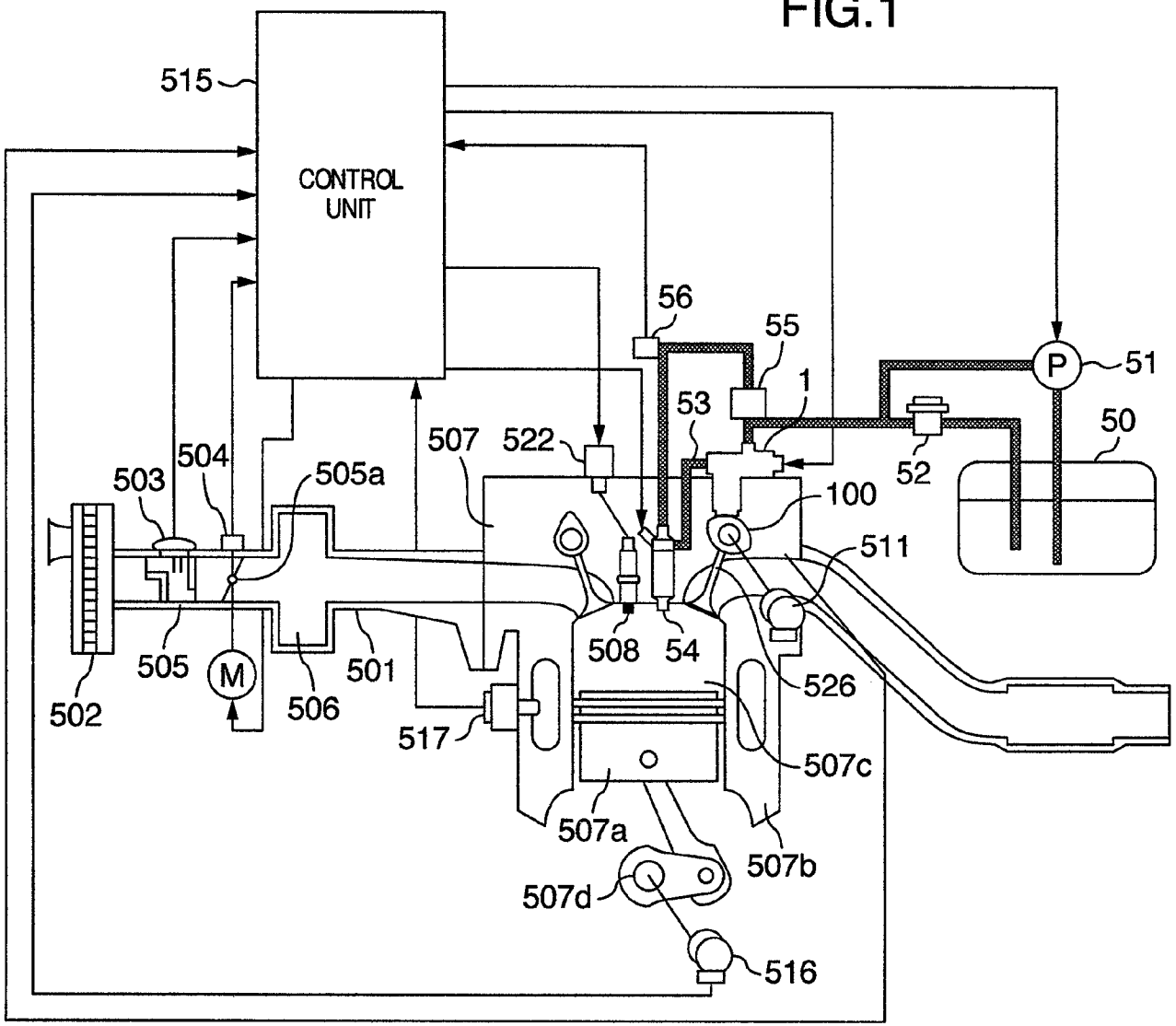
FIG. 1 is an entire configuration diagram of an engine including a high pressure fuel pump control system for an internal combustion engine of the present embodiment.

Hereinafter, one embodiment of a high pressure fuel supply control system in an internal combustion engine of the present invention will be described based on the drawings. FIG. 1 shows an entire configuration of a control system of a direct injection engine 507 of the present embodiment. The direct injection engine 507 includes four cylinders. Air, which is introduced into each cylinder 507*b*, is taken in from an inlet part of an air cleaner 502, passes through an air flow meter (air flow sensor) 503 and through a throttle body 505 housing an electrically controlled throttle valve 505*a* which controls an intake flow rate, and enters a collector 506. The air which is sucked into the above described collector 506 is distributed to each intake pipe 501 connected to each cylinder 507*b* of the engine 507, and thereafter, the air is guided to a combustion chamber 507*c* which is formed by a piston 507*a*, the above described cylinder 507*b* and the like. From the above described air flow sensor 503, a signal expressing the above described intake flow rate is output to an engine control system (control unit) 515 including the high pressure fuel pump control system of the present embodiment. Further, a throttle sensor 504 which detects an opening degree of the electrically controlled throttle valve 505*a* is attached to the above described throttle body 505, and a signal thereof is also output to the control unit 515.

Meanwhile, a fuel such as gasoline is primarily pressurized by a low pressure fuel pump 51 from the fuel tank 50, and the pressure of the fuel is regulated to a constant pressure (for example, 3 kg/cm$^2$) by a fuel pressure regulator 52, and then the fuel is secondarily pressurized to have a higher pressure (for example, 50 kg/cm$^2$) by the high pressure fuel pump 1 which will be described below, and is injected via a common rail 53 to the combustion chamber 507*c* from a fuel injection valve (hereinafter, called an injector) 54 provided at each cylinder 507*b*. The fuel which having been injected to the above described combustion chamber 507*c* is ignited with an ignition plug 508 by an ignition signal enhanced in voltage by an ignition coil 522.

A crank angle sensor (hereinafter, called a position sensor) 516 which is attached to a crankshaft 507*d* of the engine 507 outputs a signal expressing a rotational position of the crankshaft 507*d* to the control unit 515. A crank angle sensor (hereinafter, called a phase sensor) attached to a camshaft (not illustrated) including a mechanism which makes the opening and closing timing of an exhaust valve 526 variable outputs an angle signal expressing a rotational position of the above described camshaft to the control unit 515, and also outputs an angle signal expressing a rotational position of a pump drive cam 100 of the high pressure fuel pump 1 which rotates in connection with rotation of the camshaft of the exhaust valve 526 to the control unit 515. Although a variable valve timing control system is not illustrated in FIG. 1, the camshaft phase is changed by the variable valve timing control system, and the position of the above described phase sensor signal also changes in accordance with the change amount of the camshaft phase.

Figure 2:
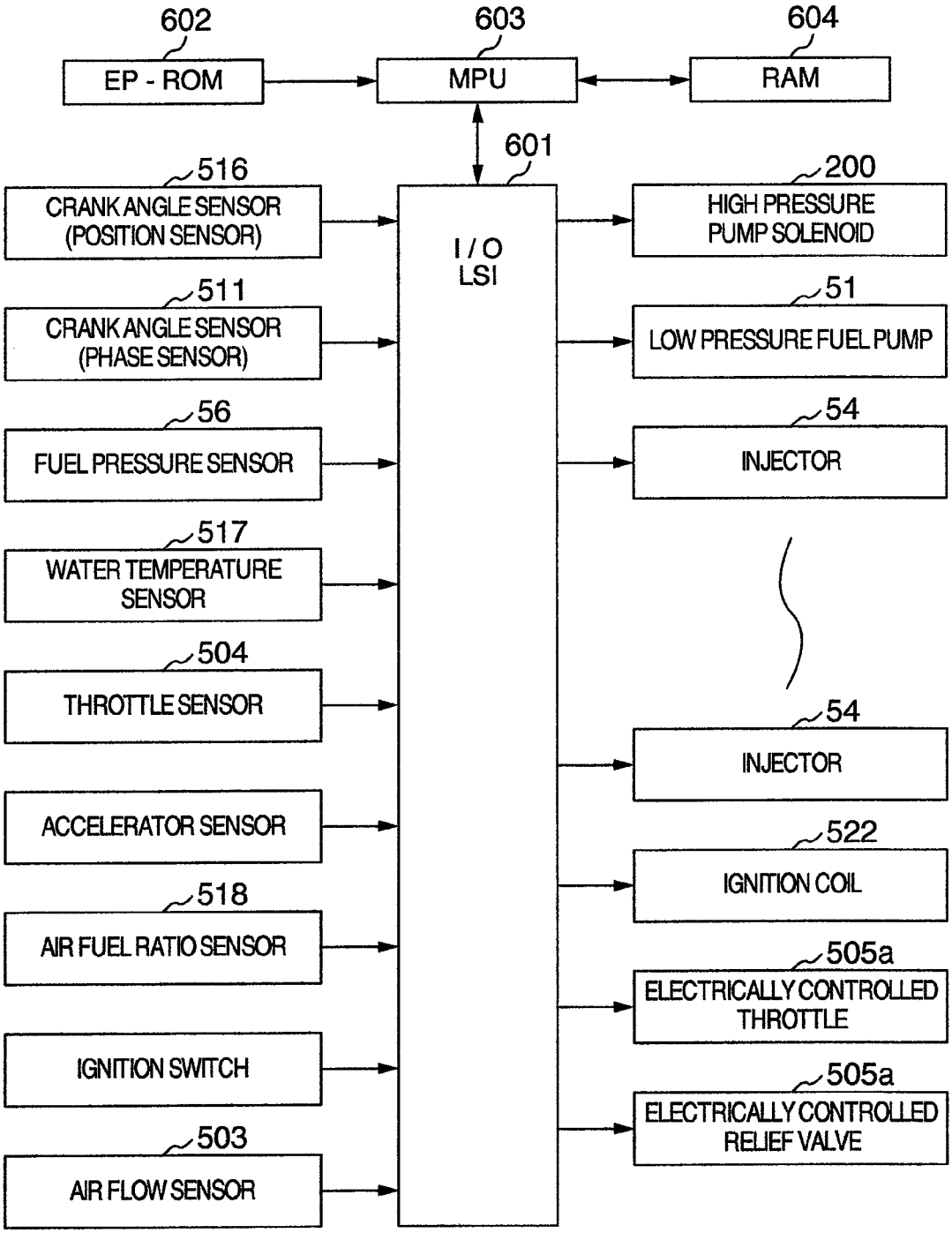
FIG. 2 is an internal configuration diagram of an engine control system of FIG. 1.

A main part of the above described control unit 515 is configured by an MPU 603, an EP-ROM 602, a RAM 604, an I/OLSI 601 including an A/D convertor and the like as shown in FIG. 2. The control unit 515 takes in signals as inputs from various sensors and the like including the position sensor 516, the phase sensor 511, a water temperature sensor 517, and a fuel pressure sensor 56, executes a predetermined calculation process, outputs various control signals calculated as a result of the calculation, supplies a predetermined control signal to a high pressure pump solenoid valve 200 which is an actuator, each of the injectors 54, the ignition coil 522 and the like, and executes fuel discharge quantity control, fuel injection quantity control, ignition timing control and the like.

Figure 3:
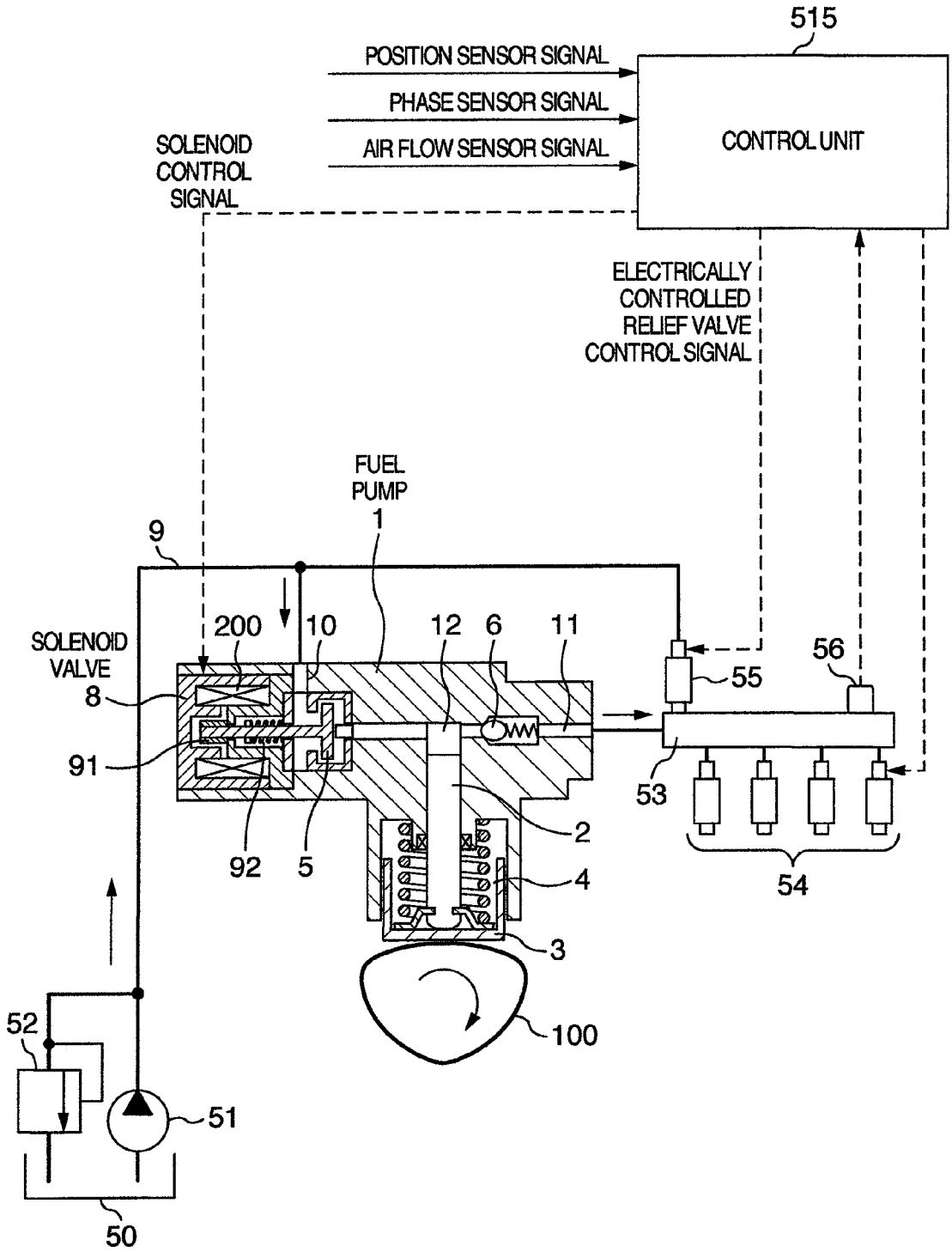
FIG. 3 is an entire configuration diagram of a fuel system including the high pressure fuel pump of FIG. 1.
Figure 4:
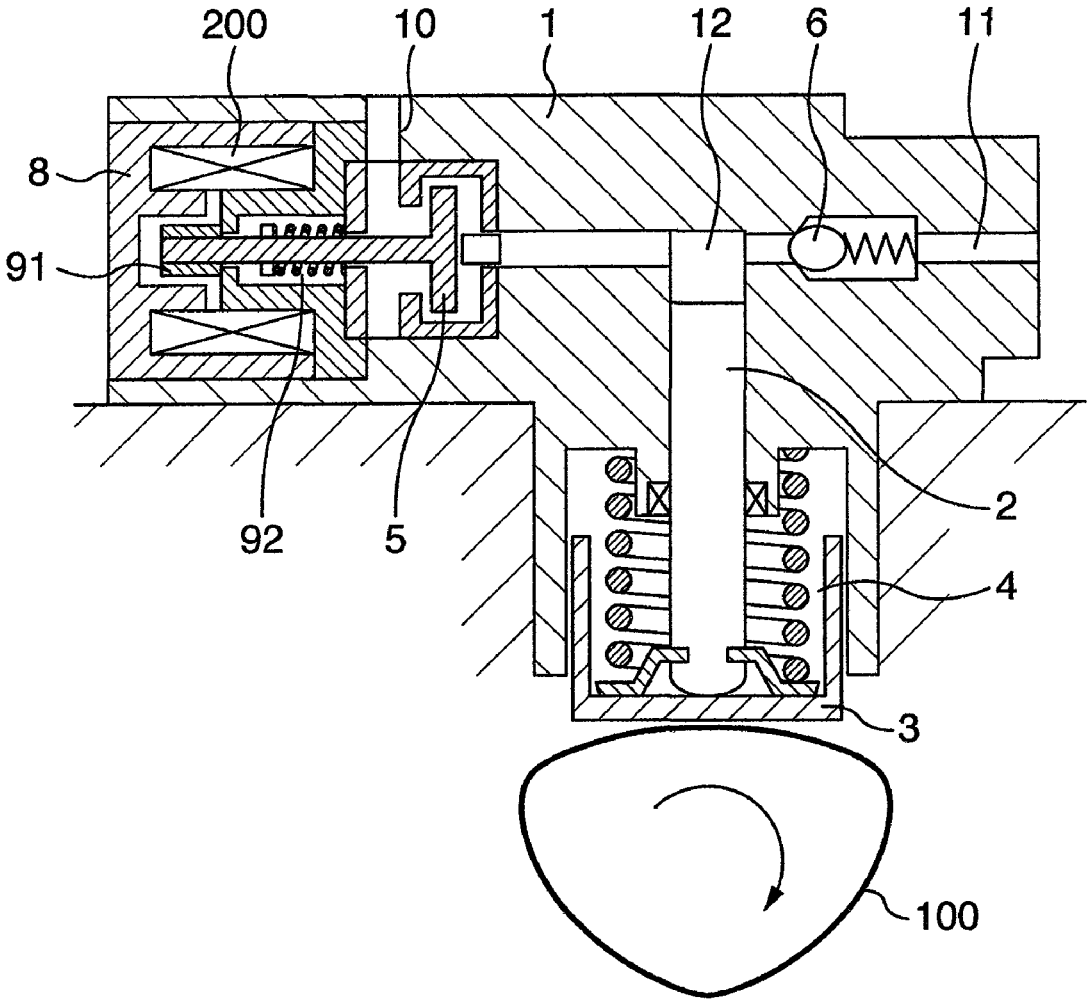
FIG. 4 is a vertical sectional view of the high pressure fuel pump of FIG. 3.

FIG. 3 shows an entire configuration diagram of a fuel system including the above described high pressure fuel pump 1, and FIG. 4 is a vertical sectional view of the above described high pressure fuel pump 1.

The above described high pressure fuel pump 1 pressurizes the fuel from the fuel tank 50 and feeds the high-pressure fuel with pressure to the common rail 53, and a fuel suction passage 10, a discharge passage 11 and a pressurizing chamber 12 are formed therein. In the pressurizing chamber 12, a plunger 2 which is a pressurizing member is slidably held. The discharge passage 11 is provided with a discharge valve 6 which prevents the high-pressure fuel at a downstream side from flowing back to the pressurizing chamber. Further, the suction passage 10 is provided with a solenoid valve 8 which controls suction of the fuel. The solenoid valve 8 is a normal close type of solenoid valve, in which force acts in a valve closing direction when power is not distributed, whereas force acts in a valve opening direction when power is distributed.

A fuel is guided to a fuel introduction port of the pump main body 1 by the low pressure pump 51 from the tank 50 by being regulated to a constant pressure by the pressure regulator 52. Thereafter, the fuel is pressurized in the pump main body 1, and is fed with pressure to the common rail 53 from a fuel discharge port. The injector 54, the pressure sensor 56, a pressure regulation valve (hereinafter, called a relief valve) 55 are mounted on the common rail 53. The relief valve 55 opens when the fuel pressure in the common rail 53 exceeds a predetermined value to prevent breakage of a high pressure piping system. The injectors 54 are mounted corresponding to the number of cylinders of the engine, and inject a fuel in accordance with a drive current given by the control unit 515. The pressure sensor 56 outputs obtained pressure data to the control unit 515. The control unit 515 calculates a suitable injection fuel quantity, fuel pressure and the like based on the engine state quantities (for example, a crank rotational angle, a throttle opening degree, an engine speed, a fuel pressure and the like) obtained from various sensors, and controls the high pressure pump 1 and the injector 54.

The plunger 2 reciprocates via a lifter 3 which is pressured to contact with a pump drive cam 100 which rotates in accordance with rotation of the camshaft of the exhaust valve 526 in the engine 507, and changes the capacity of the pressurizing chamber 12. When the plunger 2 descends so that the capacity of the pressurizing chamber 12 is increased, the solenoid valve 8 opens, and the fuel flows into the pressurizing chamber 12 from the fuel suction passage 10. The stroke in which the plunger 2 descends will be described as a suction stroke hereinafter. When the plunger 2 ascends and the solenoid valve 8 is closed, the fuel in the pressurizing chamber 12 is increased in pressure, and is fed with pressure through the discharge valve 6 to the common rail 53. The stroke in which the plunger 2 ascends will be described as a compression stroke hereinafter.

Figure 5:
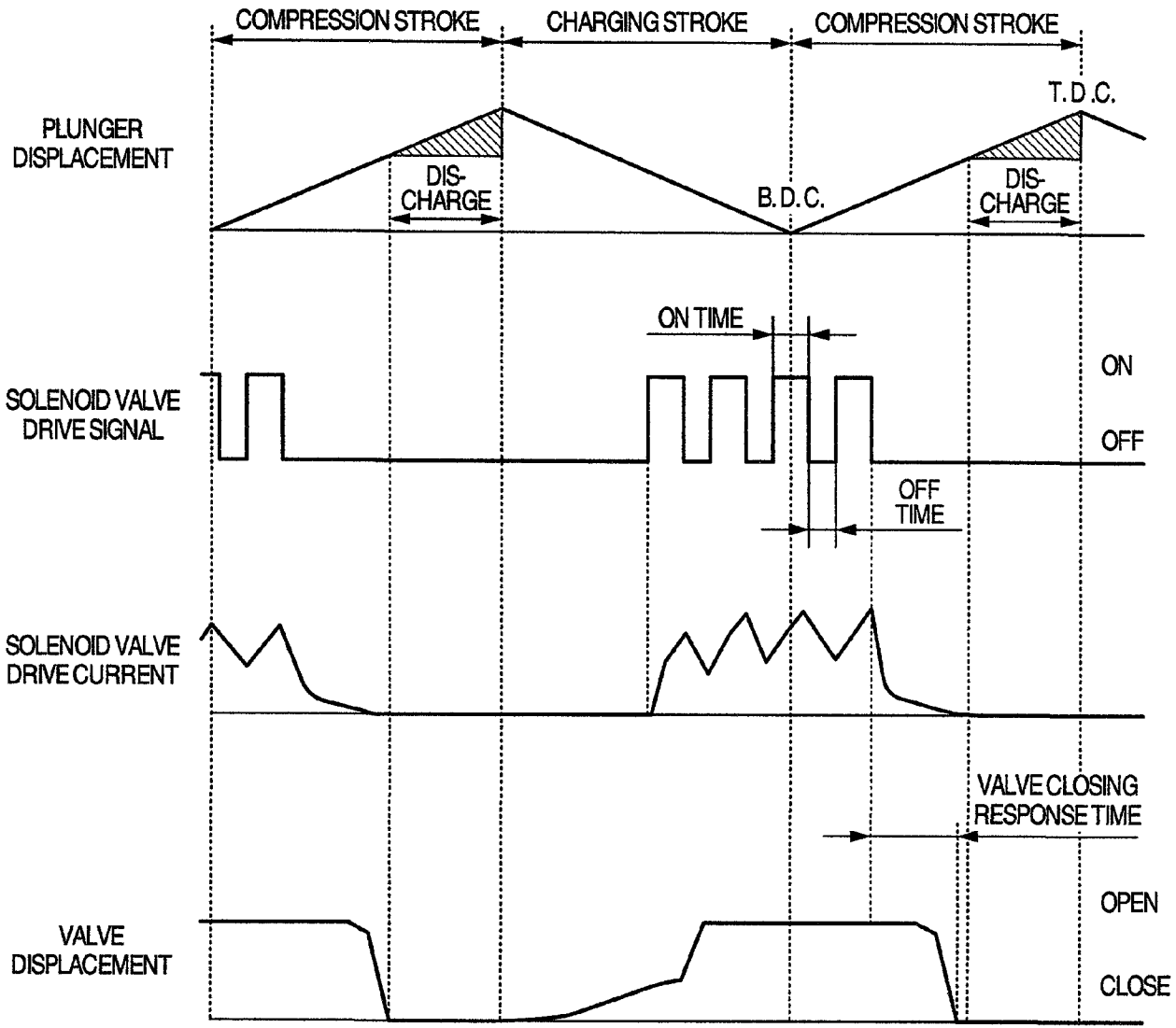
FIG. 5 is an operation timing chart of the high pressure fuel pump of FIG. 3.
Figure 6:
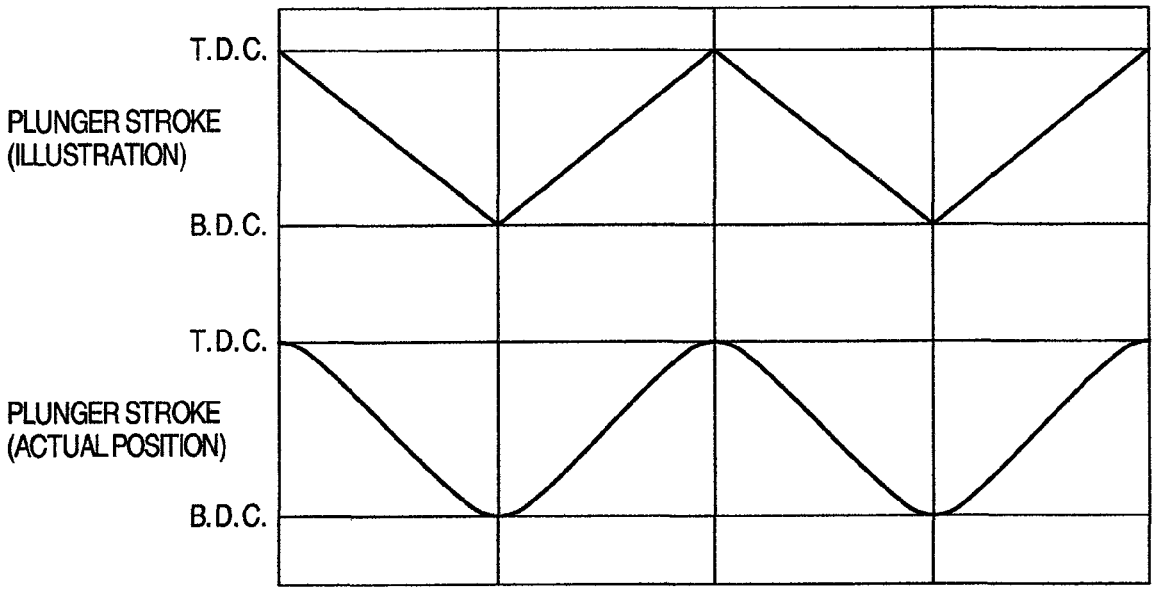
FIG. 6 is a supplementary explanatory diagram of the operation timing chart of FIG. 5.

FIG. 5 shows an operation timing chart of the above described high pressure fuel pump 1. The actual stroke (actual position) of the plunger 2 which is driven by the pump drive cam 100 becomes the curve as shown in FIG. 6, but in order to make it easy to understand the positions of the T. D. C and B. D. C, the stroke of the plunger 2 will be expressed linearly hereinafter.

When the solenoid valve 8 closes during the compression stroke, the fuel having been sucked into the pressurizing chamber 12 during the suction stroke is pressurized, and discharged to the common rail 53 side. If the solenoid valve 8 opens during the compression stroke, the fuel is forced to return to the suction passage 10 side during this time, and the fuel in the pressurizing chamber 12 is not discharged to the common rail 53 side. As such, fuel discharge of the high pressure pump 1 is operated by opening and closing the solenoid valve 8. Opening and closing of the solenoid valve 8 is operated by the control unit 515.

The solenoid valve 8 has a valve 5, a spring 92 for urging the valve 5 in the valve closing direction, a solenoid 200 and an anchor 91 as components. When a current is passed to the solenoid 200, electromagnetic force occurs to the anchor 91, and the anchor 91 is drawn to the right side in the drawing. The valve 5 formed integrally with the anchor 91 is opened. When the current is not passed to the solenoid 200, the valve 5 is closed by the spring 92 which urges the valve 5 in the valve closing direction. Since the solenoid valve 8 is a valve having the structure which closes under the state where a drive current is not passed, it is called a normal close type of solenoid valve.

During suction stroke, the pressure of the pressurizing chamber 12 becomes lower than the pressure of the suction passage 10, and the valve 5 is opened due to the pressure difference thereof, so that the fuel is sucked into the pressurizing chamber 12. At this time, the spring 92 urges the valve 5 in the valve closing direction, but the valve opening force due to the pressure difference is set to be larger, and therefore the valve 5 opens. If a drive current is applied to the solenoid 200 at this moment, the magnetic attraction force acts in the valve opening direction, and the valve 5 is more easily opened.

Meanwhile, during the compression stroke, the pressure of the pressurizing chamber 12 becomes higher than that of the suction passage 10, and therefore, such a differential pressure that the valve 5 is opened does not occur. If the drive current is not applied to the solenoid 200 here, the valve 5 is closed by the spring force and the like which urge the valve 5 in the valve closing direction. Meanwhile, if the drive current is applied to the solenoid 200 so that sufficient magnetic attraction force occurs, the valve 5 is urged in the valve opening direction by the magnetic attraction force.

Thus, if the drive current starts to be supplied to the solenoid 200 of the solenoid valve 8 during the suction stroke, and is also continued to be supplied during the compression stroke, the valve 5 is kept open. During this time, the fuel in the pressurizing chamber 12 flows back to the low pressure passage 10, and therefore, the fuel is not fed by pressure into the common rail. Meanwhile, if supply of the drive current is stopped at a certain moment during the compression stroke, the valve 5 is closed, and the fuel in the pressurizing chamber 12 is pressurized and is discharged to the discharge passage 11 side. If the timing of stopping supply of the drive current is early, the capacity of the fuel to be pressurized becomes large, whereas if the timing is late, the capacity of the fuel to be pressurized becomes small. Therefore, the control unit 515 can control the discharge flow rate of the high pressure pump 1 by controlling the timing at which the valve 5 closes.

Further, by suitably calculating the timing of turning OFF the power distribution at the control unit 515 based on the signal of the pressure sensor 56 to control the solenoid 200, the pressure of the common rail 53 can be feedback-controlled to be a target value.

Figure 7:
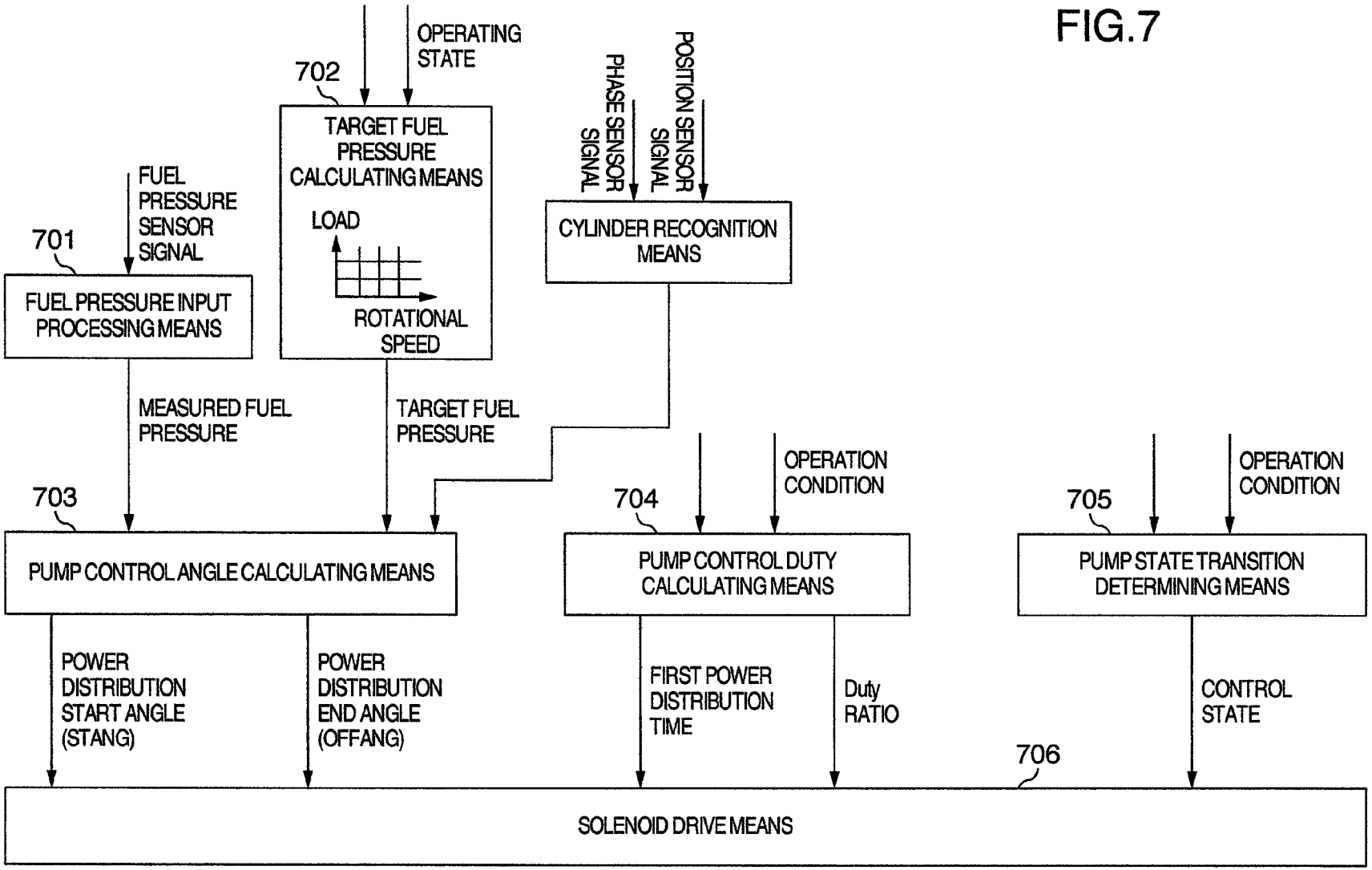
FIG. 7 is a block diagram of control of the present invention according to an internal combustion engine control system of FIG. 1.

FIG. 7 shows one mode of a control block diagram of the high pressure fuel pump 1 that is carried out by the MPU 603 of the control unit 515 including the above described high pressure fuel pump control system. The above described high pressure fuel pump control system is configured by a fuel pressure input processing means 701 which performs filter processing of a signal from the fuel pressure sensor 56 and outputs an actual fuel pressure, a target fuel pressure calculating means 702 which calculates an optimal target fuel pressure from the engine speed and load for its operating point, a pump control angle calculating means 703 which calculates a phase parameter for controlling the discharge flow rate of the pump, a pump control DUTY calculating means 704 which calculates a parameter of a duty signal which is a pump drive signal, a pump state transition determining means 705 which determines the state of the direct injection engine 507 and changes the pump control mode, and a solenoid drive means 706 which gives the current generated from the above described duty signal to the solenoid 200.

Figure 8:
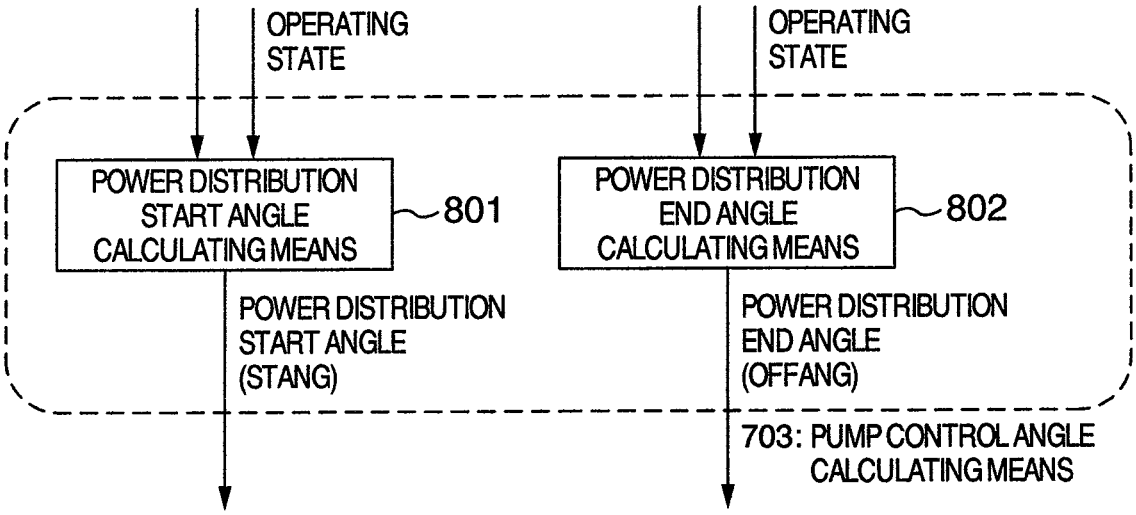
FIG. 8 is a block diagram of control of the present invention according to the internal combustion engine control system of FIG. 1.

FIG. 8 shows one mode of the pump control angle calculating means 703. The pump control angle calculating means 703 is configured by a power distribution start angle calculating means 801 and a power distribution end angle calculating means 802.

Figure 9:
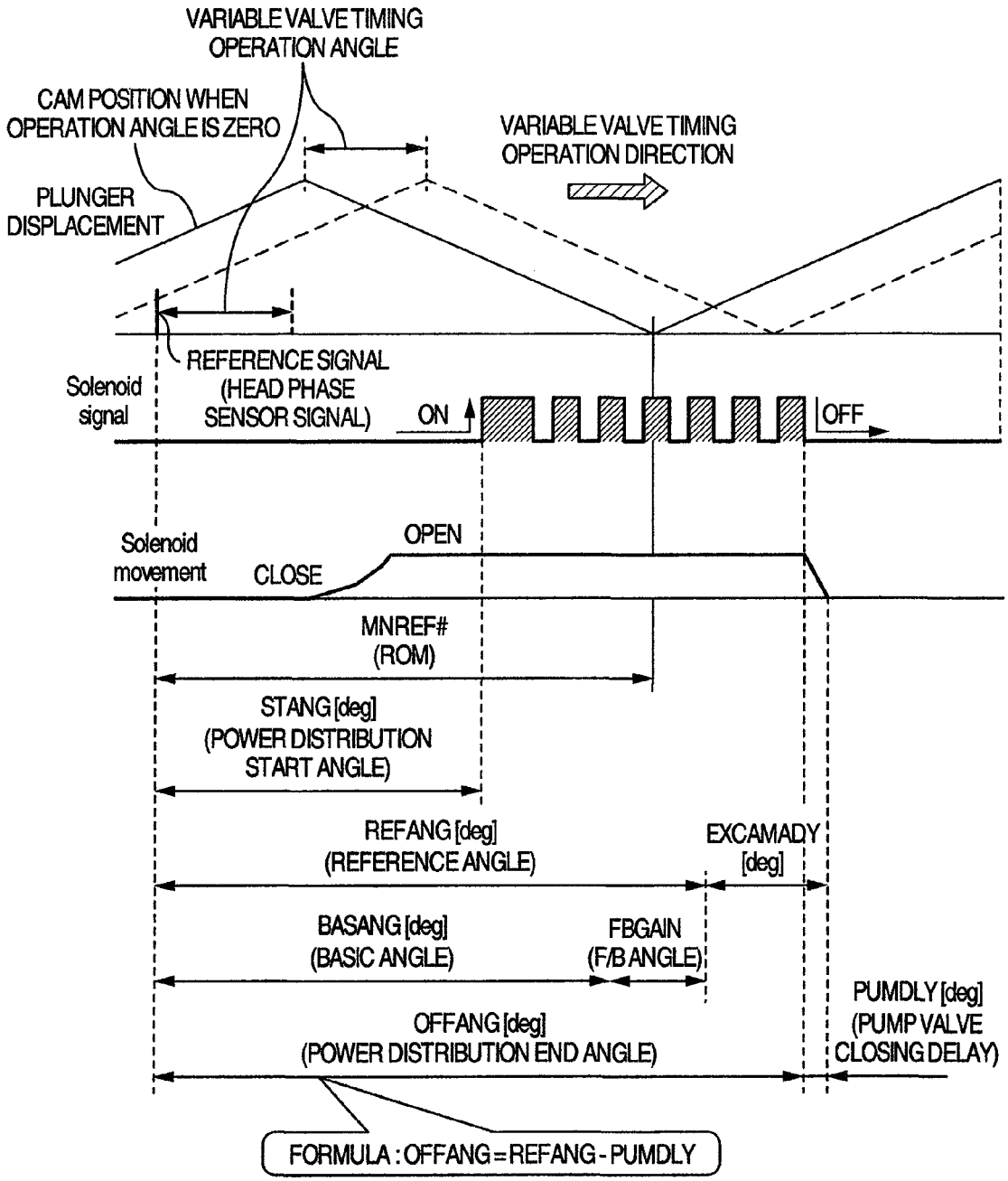
FIG. 9 is a time chart of control of the present invention according to the internal combustion engine control system of FIG. 1.

FIG. 9 shows one mode of the power distribution start angle calculating means 801. A basic power distribution start angle STANGMAP is calculated from a basic power distribution start angle calculation map 801 in which the engine speed and battery voltage are input, and a power distribution start angle STANG from a reference signal (a signal position of the head of the above described phase sensor signal) of the high pressure fuel pump control angle by the phase sensor signal which changes in accordance with the phase change by the variable valve timing mechanism of the above described pump drive camshaft is calculated. The phase by the variable valve timing mechanism is at the retarding angle position shown by the dotted line with respect to the advance angle position shown by the solid line in FIG. 9, and control is performed for each of the phases with the value at which the power distribution start angle from the reference position itself does not change.

Figure 10:
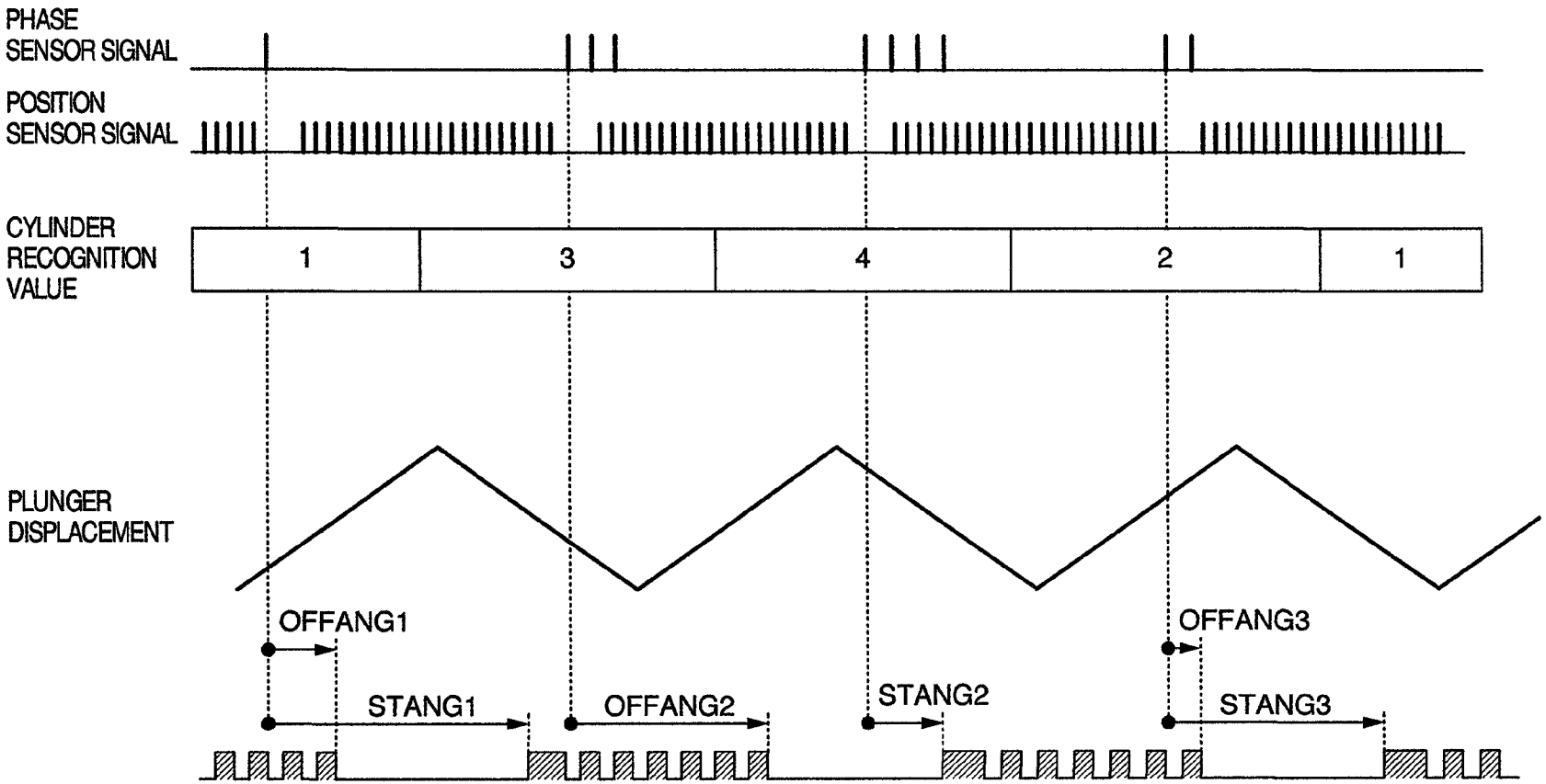
FIG. 10 is a time chart of control of the present invention according to the internal combustion engine control system of FIG. 9.

FIG. 10 shows one example of a time chart in the range where the internal combustion engine rotates two times in the case that the number of cam noses for driving the high pressure fuel pump is three in the four-cylinder internal combustion engine. From the position (the reference signal shown in the above described FIG. 9) at the head of the phase sensor signals shown at the uppermost stage in FIG. 10, the ON timings of the solenoid valve of the high pressure fuel pump from respective head phase sensor signals are respectively STANG 1 to 3, and the OFF timings of the solenoid valves are respectively OFFANG 1 to 3. The above described respective STANG 1 to 3 and OFFANG 1 to 3 are at different angles from the respective reference positions, and need to be properly used for each head phase sensor signal, and the proper use is performed in accordance with the cylinder recognition value in FIG. 10. For example, from the head phase signal at the time of the cylinder recognition value=1, control of the solenoid valve is performed with the angles of OFFANG 1 and STANG 1. From the head phase signal at the time of the cylinder recognition value=3, control of the solenoid valve is performed with the angle of OFFANG 2 which is a value different from the above described OFFANG 1. By properly using the ON (STANG) timing and OFF (OFFANG) timing of the solenoid valve based on the head phase sensor signal and the cylinder recognition value of the internal combustion engine like this, the ON/OFF timing of the desired solenoid valve in the high pressure fuel pump is controlled without being limited to the number of cylinders of the internal combustion engine or the mode of the phase sensor signal and the number of drive cam noses of the high pressure fuel pump, and thereby, the fuel discharge quantity from the high pressure fuel pump can be stably controlled.

Figure 11:
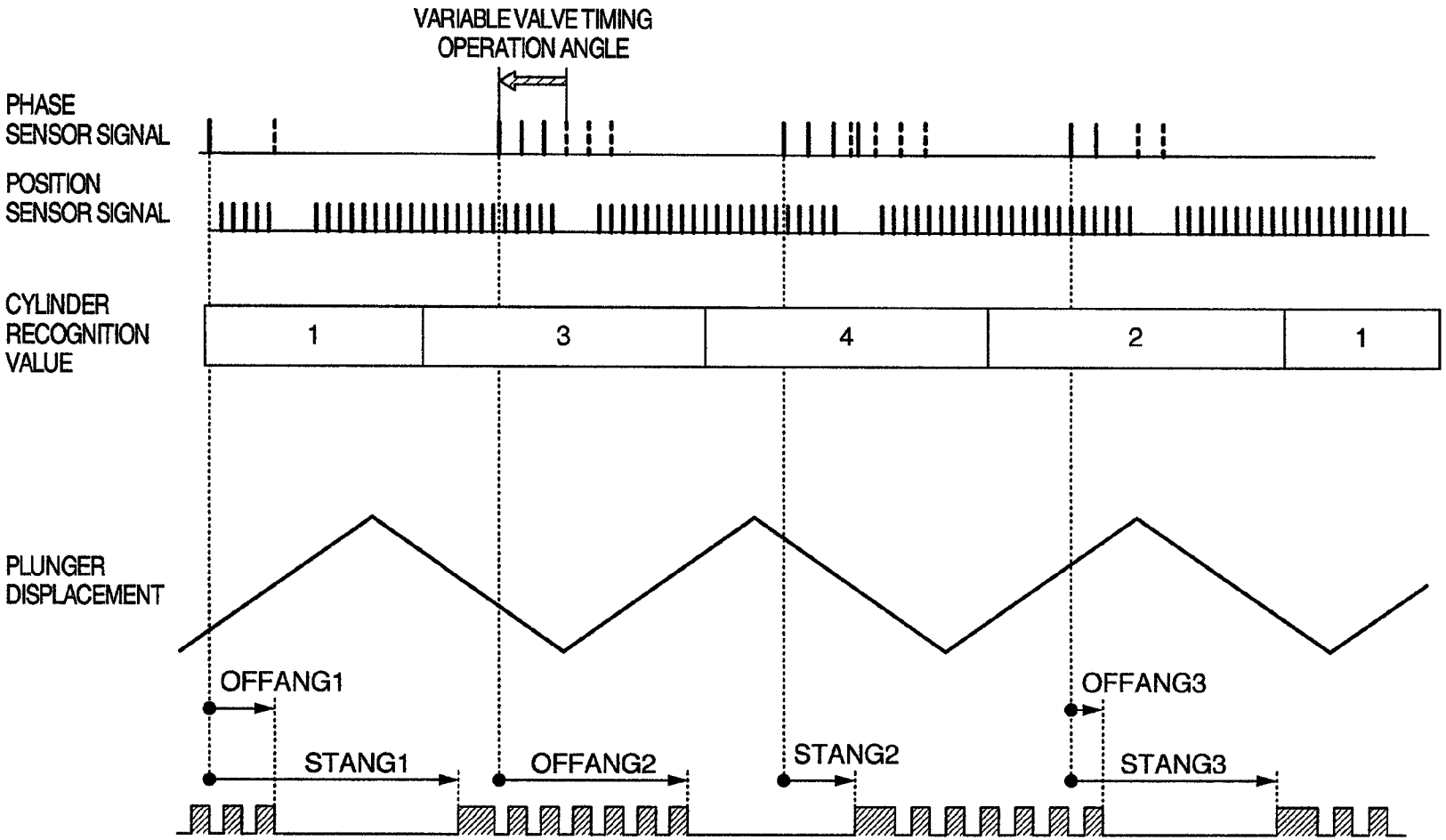
FIG. 11 is a time chart of control of the present invention according to the internal combustion engine control system of FIG. 9.

FIG. 11 shows a time chart when the camshaft phase shifts to an advancing angle side by the variable valve timing control system with respect to the above descried FIG. 10. The positions shown by the dotted lines of the phase sensor signal at the upper stage in FIG. 11 correspond to the positions described in connection with the above described FIG. 10, whereas the phase sensor signals shown by the solid lines are at the positions where the phase of the camshaft changes by the above described variable valve timing control system. Even when the phase of the camshaft changes as described above, the relationship of the phase of the high pressure fuel pump drive cam nose of the camshaft with the output position of the phase sensor signal does not break. Therefore, the ON (STANG 1 to 3) timing and the OFF (OFFANG 1 to 3) timing of the solenoid valve from the respective head phase sensor signals described in connection with the above described FIG. 10 will be controlled with the same value.

Figure 12:
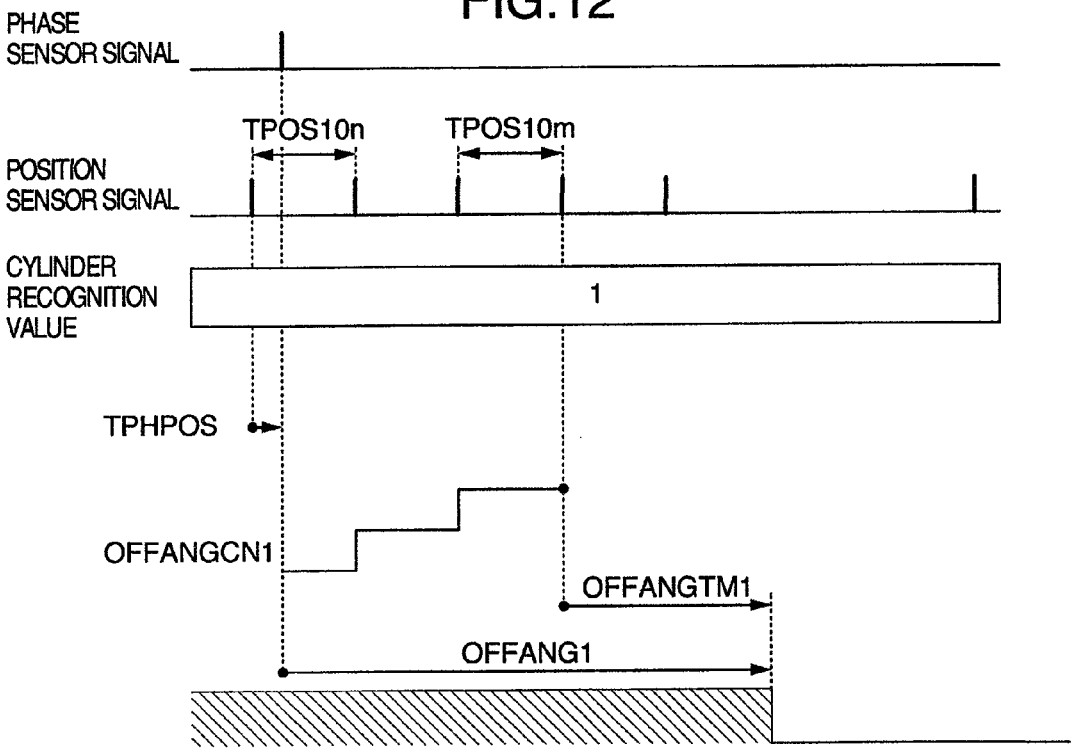
FIG. 12 is an angle control method from FIG. 9 to FIG. 10.

FIG. 12 shows one example of the angle control method for ON/OFF control of the above described solenoid valve with the position of the above described head phase sensor signal as the reference position, and the angle control method will be described with the OFF timing as an example. The angle control in the ON timing may be performed also by the method which will be described as follows.

As described above, the OFF timing of the solenoid valve is controlled with the phase sensor signal at the upper stage in FIG. 12 as the reference position. The position sensor signal shown at the intermediate stage of FIG. 12 generally has an interval (for example, 10 deg interval) larger than the control precision of the above described solenoid valve (for example, control precision of 0.1 deg). When angle control with the above described phase sensor signal as the reference position is performed, the number of position sensor signals from the reference position is counted, and thereafter, time control from the position sensor is performed from the position sensor signal interval (TPOS 10). When describing this control using the example shown in FIG. 12, in order to achieve the angle OFFANG 1 from the reference position, three position sensor signals (OFFANGCN 1) from the reference position are counted, and thereafter, at the point of time when the time (OFFANGTM 1) corresponding to the remaining angle is measured from the value obtained by measuring the interval of the position sensor signal (TPOS 10*m*), the OFF timing of the solenoid valve is controlled.

It is controlled as follows.

OFFANG 1=OFFANGCN 1 (number of position sensor signals)+OFFANGTM 1 (time at which the angle is obtained based on the time from the position sensor signal interval)

In addition, when performing angle control by using the position sensor signal, it is necessary to confirm the relative relation position of the position of each of the head phase sensor signals and the position sensor signal accurately. Therefore, it is necessary to calculate the value (TPHPOS) which is measured from the interval (TPOS 10*n*) of the position sensor signals before and after the head phase sensor signal shown in the drawing is input. In short, angle control is enhanced in precision by calculating OFFANG 1 by the following method.

OFFANG 1=(TPOS 10*n*−TPHPOS)+OFFANGCN 1+OFFANGTM 1

Here, (TPOS 10*n*−TPHPOS) and OFFANGTM 1 of the above described expression may be calculated and set in accordance with the interval (crank angle) of the position sensor signals of the internal combustion engine to which it is applied. The calculation method does not have to be described in detail because calculation can be performed simply from the relationship of the crank angle and time.

Figure 13:
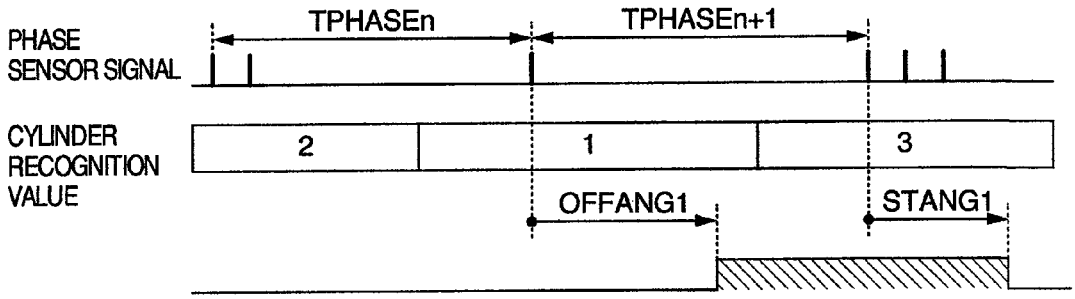
FIG. 13 is a time chart of control of the present invention according to the internal combustion engine control system of FIG. 1.

FIG. 13 shows one example of the angle control method for controlling ON/OFF of the above described solenoid valve only by the phase sensor signal without using the position sensor signal.

When measuring the signal interval of the head phase sensor, and obtaining OFFANG 1 from the head phase sensor signal at the time of the cylinder recognition value=1, for example, the calculation may be performed based on the interval (TPHASE n) of the last head phase sensor signals. For example, when OFFANG 1=90 deg is calculated, and when the head phase signal interval is 180 deg, control can be carried out with the value which is half the above described measured time of TPHASE n (=time at 90 deg/time at 180 deg).

As such, the ON/OFF timing of the solenoid of the high pressure fuel pump can be controlled only with a phase sensor signal and a cylinder recognition value without using a position sensor signal. This not only reduces the calculation load of the CPU in the control system of the internal combustion engine, but also realizes the desired fuel discharge control of the high pressure fuel pump even when abnormality (failure) occurs to the position sensor signal of the internal combustion engine.

Figure 14:
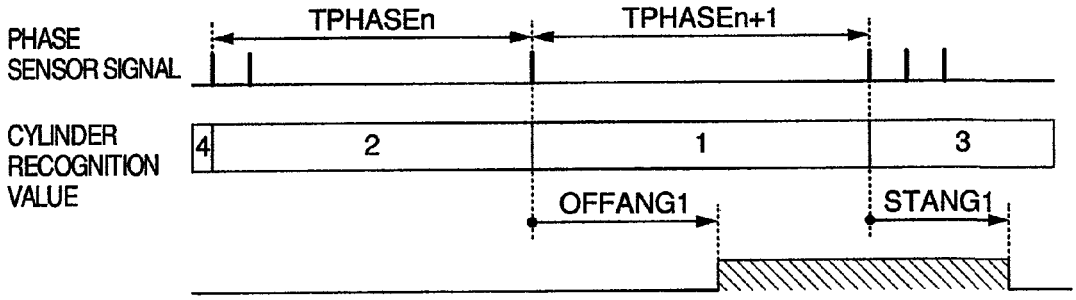
FIG. 14 is a time chart of control of the present invention according to the internal combustion engine control system of FIG. 1.

FIG. 14 shows one example of the case where the phase of the camshaft changes by the variable valve timing control system with respect to the above described FIG. 13. Even when the phase of the camshaft changes like this, control can be performed without being conscious of the variable valve timing when the ON/OFF control of the solenoid valve of the high pressure pump if performed based on the phase sensor signal and the cylinder recognition value.

Figure 15:
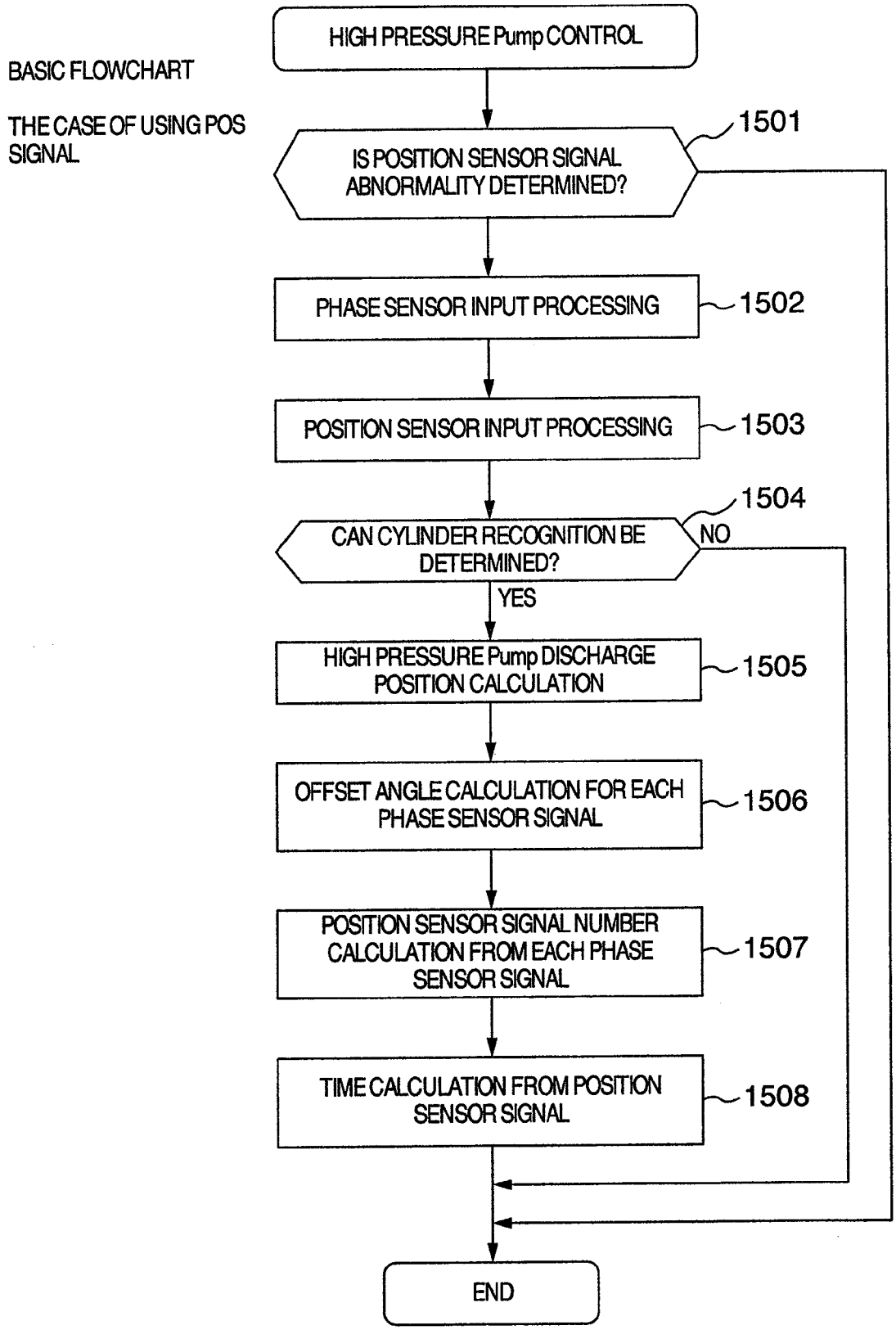
FIG. 15 is a flowchart of control of the present invention according to the internal combustion engine control system of FIG. 1.

FIG. 15 shows one example of the control flowchart of the content described with the above described FIGS. 10 and 11.

In block 1501, it is determined whether the position sensor signal is normal or a failure. In this case, the failure determining method is not directly related to the present invention, and therefore, detailed description thereof is not required. When the position sensor signal is normal, the flow goes to the processing of block 1502, and when the position sensor signal is abnormal, it is controlled in accordance with the contents of FIG. 16 which will be described later. In block 1502, input processing of the above described phase sensor signal provided at the camshaft of the internal combustion engine is performed. The processing is for mainly performing discrimination of the head phase signal, and measuring the input timing of the head phase and the number of phase sensor signals. In block 1503, input processing of the position sensor signal for measuring the crank angle of the internal combustion engine is performed. The processing is for mainly measuring the crank angle of the internal combustion engine and measuring the interval time of the position sensor signals. In block 1504, cylinder recognition processing of the internal combustion engine is performed by the above described phase sensor signal and position sensor signal. When cylinder recognition of the internal combustion engine is performed, the discharge position of the high pressure fuel pump is calculated in block 1505. More specifically, the timing of turning ON/OFF the solenoid valve in the high pressure fuel pump is calculated (the angles of the above described STANG and OFFANG are calculated). In block 1506, the offset amount of different ON/OFF timing of the solenoid valve obtained from each of the cylinder recognition values and the above described head phase sensor is calculated. Thereby, the respective values of STANG 1 to 3 and OFFANG 1 to 3 described in connection with the above described FIGS. 10 and 11 are calculated. In block 1507, the number of position signals for realizing the angles of STANG 1 to 3 and OFFANG 1 to 3 calculated in the above described block 1506 is calculated. The concrete method for obtaining the number of position sensor signals is in accordance with the method shown in the above described FIG. 12, and the description thereof will be omitted here since it becomes repetition of that of FIG. 12. Next, in block 1706, the time control amount calculated based on the time between the position sensor signals other than the number of position sensor signals obtained in the above described block 1507 among the angles of the above described STANG 1 to 3 and OFFANG 1 to 3 is calculated. This time control method is also in accordance with the method shown in the above described FIG. 12, and description thereof will be omitted since it becomes repetition of that of FIG. 12 FIG. 17 shows one example of a flowchart of the method for further enhancing the ON/OFF timing control precision of the solenoid valve of the high pressure fuel pump from the relationship of the head phase sensor signal position and the position sensor signal by the variable valve timing control which is described in connection with the above described FIG. 12. In block 1701, the position of the head phase sensor signal is calculated by calculating a time TTOPPH from the last position sensor signal just before the head phase sensor signal is input, and the time interval between the above described last position sensor signal and the next position sensor signal. In block 1702, the discharge position of the high pressure fuel pump is calculated, which is the same processing as the block 1505 described in connection with the above described FIG. 15. In block 1703, STANG 1 to 3 and OFFANG 1 to 3 which are the solenoid valve ON/OFF timings of the high pressure fuel pump of block 1506 described in connection with the above described FIG. 15 are calculated. In block 1704 to block 1706, the actual angle from the head phase sensor signal is obtained as described in the above described FIG. 12, as follows.

$$\text{OFFANG } n = (\text{TPOS } 10n - \text{TPHPOS}) + \text{OFFANGCN } n + \text{OFFANGTM } n.$$

In the above described formula, OFFANG n (n differs for every cylinder) is calculated in the above described block 1703, and (TPOS 10*n*−TPHPOS) is calculated in the above described block 1701.

OFFANGCN n (n differs for every cylinder), which is the number of position sensor signals from the head phase sensor signal, is calculated in block 1705, and OFFANGTM n (n differs for every cylinder), which is the angle after the number of the above described position sensor signals corresponds to the measured number, is calculated in block 1708.

According to the above method, by the variable valve timing control system, even when the phase of the phase sensor signal changes, accurate control of the ON/OFF timing of the solenoid valve of the high pressure fuel pump can be performed by using the position sensor signals.

Figure 16:
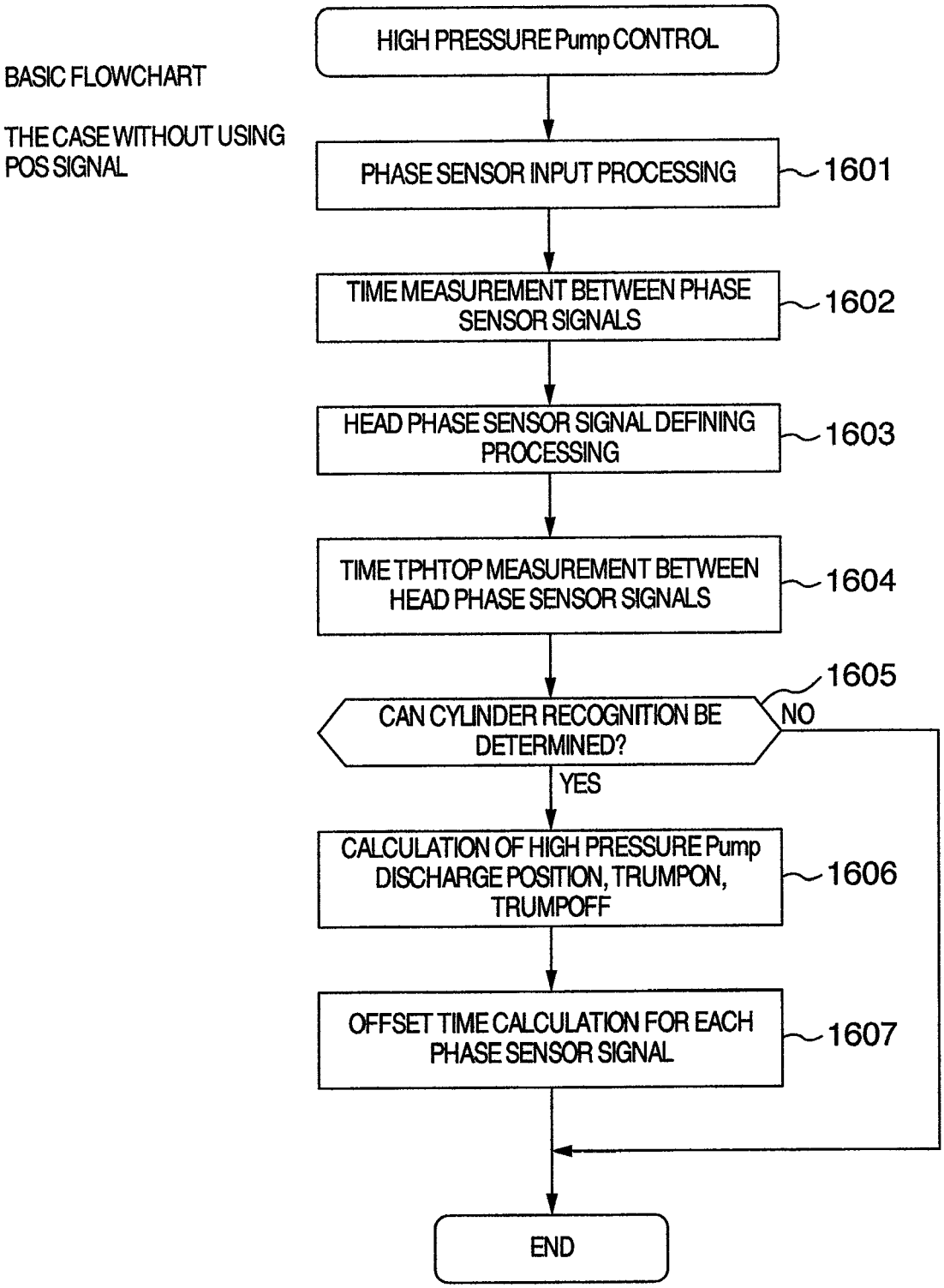
FIG. 16 is a flowchart of control of the present invention according to the internal combustion engine control system of FIG. 1.
Figure 17:
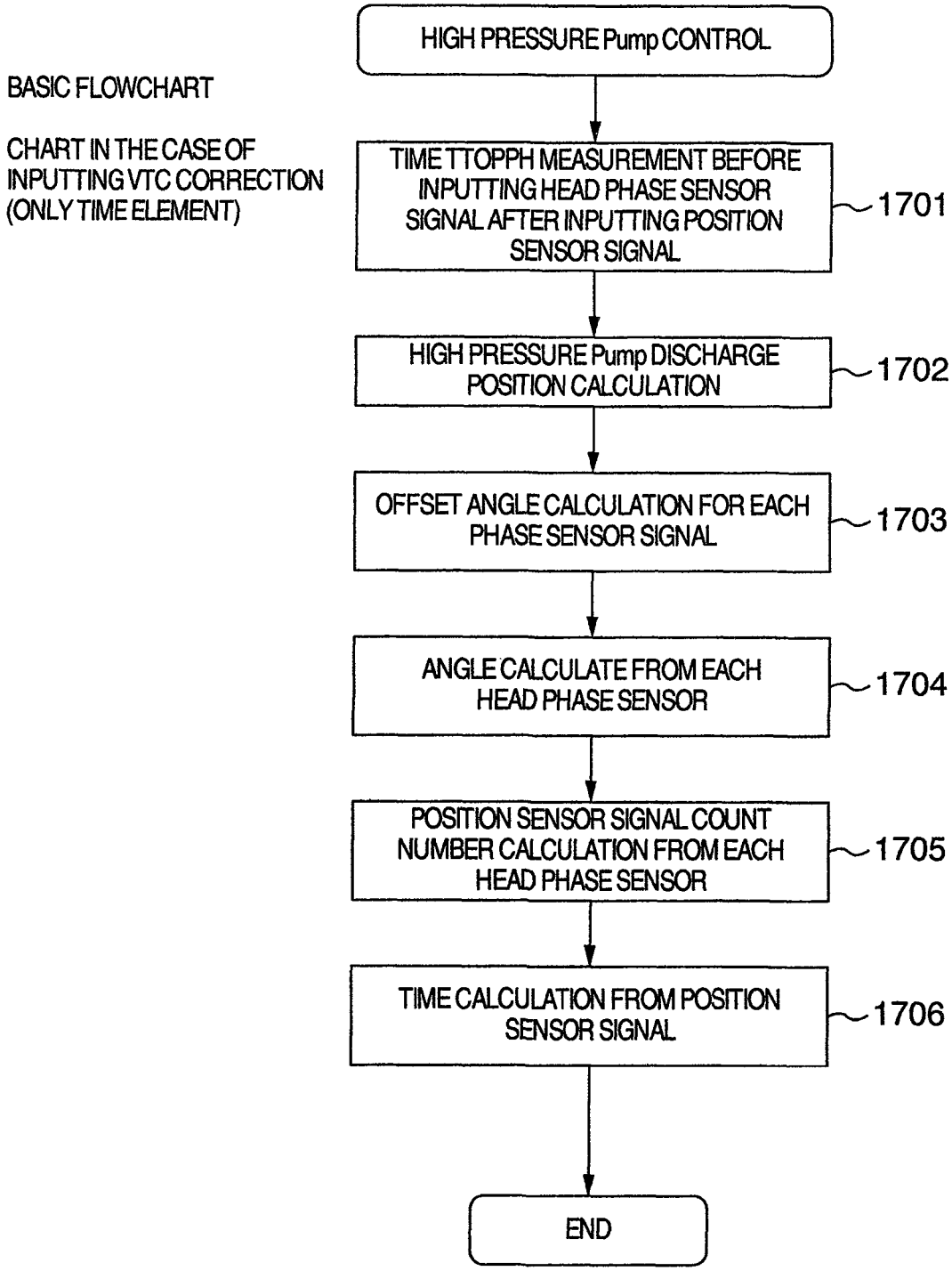
FIG. 17 is a flowchart of control of the present invention according to the internal combustion engine control system of FIG. 1.

FIG. 16 shows one example of a flowchart of the ON/OFF timing control of the solenoid valve of the high pressure fuel pump by the phase sensor signal and the cylinder recognition value described in connection with the above described FIGS. 13 and 14. In block 1601, input processing of the phase sensor is performed as in block 1502 of the above described FIG. 15. In block 1602, the time interval of the phase sensor signals is measured based on the processing in the above described block 1601. In block 1603, defining processing of the head phase sensor signal is performed based on the processing of the above described block 1601. In block 1604, time (TPHTOP) between the head phase sensor signals is measured based on the defining processing of the above described head phase sensor signal. When the cylinder recognition value is defined in block 1602, TPUMPON and TPUMPOFF which are ON/OFF timings of the solenoid valve of the high pressure fuel pump are calculated in block 1606 based on the time (TPHTOP) between the head phase sensor signals, which is calculated in the above described block 1604. Here, the method for calculating the TPUMPON and TPUMPOFF based on the TPHTOP is as described with the above described FIG. 13, and the description thereof will be omitted here because of duplication. In the next block 1607, the offset of each head phase sensor signal is calculated as in block 1506 of the above described FIG. 15 and block 1703 of FIG. 17.

The on/off timing control of the solenoid valve of the high pressure fuel pump is capable of stable fuel discharge control from the high pressure fuel pump even by any of the methods of FIGS. 15 and 17 as well as the method of FIG. 16 using the position sensor signal as above even when the camshaft phase changes by the variable valve timing control system. However, when abnormality exists at least in the position sensor signal, control which does not depend on the position sensor signal in FIG. 16 can be performed.

In the present invention, the control method of the normal close type of high pressure fuel pump described in the above described FIG. 4 is described as an example. However, even when a normal open type of high pressure fuel pump is applied, and even in the case of the method based only on the ON timing control of the solenoid valve using the phase sensor signal, or the position sensor signal and the cylinder recognition value, the same control can be performed, and the present invention is not restricted by the mechanism of the high pressure fuel pump.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A high pressure fuel pump control system for an internal combustion engine, comprising:

a camshaft which is driven in synchronization with a crankshaft of the internal combustion engine;

a cam angle detecting means which generates a cam angle signal in synchronization with rotation of the camshaft;

a crank angle detecting means which generates a crank angle signal in synchronization with rotation of the crankshaft;

a means which carries out cylinder recognition of the internal combustion engine by the cam angle detecting means and the crank angle detecting means;

a high pressure fuel pump having a suction stroke and a spill stroke of the high pressure fuel pump in synchronization with the rotation of the camshaft; and a means which changes an effective stroke by driving a solenoid valve in the high pressure fuel pump in connection with the spill stroke of the high pressure fuel pump, wherein the means which drives the solenoid valve in the high pressure fuel pump operates in synchronization with the cam angle detecting means and the crank angle detecting means, and determines timing of the driving, with a cylinder recognition value and the cam angle detecting means as a reference position, and wherein the means which determines timing of the driving from the cam angle detecting means based on the cylinder recognition value performs time control based on the number of the crank angle signals and a period of the crank angle signal by the crank angle detecting means from the cam angle detecting means.

2. The high pressure fuel pump control system for an internal combustion engine according to claim 1, wherein the means which determines timing of the driving from the cam angle detecting means changes the drive timing based on the cylinder recognition value.

3. The high pressure fuel pump control system for an internal combustion engine according to claim 1, wherein the means which determines timing of the driving from the cam angle detecting means performs a change based on time from the crank angle signal at which time at least the cam angle signal is detected.

* * * * *